United States Patent [19]

Beyer

[11] Patent Number: 4,577,985

[45] Date of Patent: Mar. 25, 1986

[54] RING BINDER

[76] Inventor: Lewis R. Beyer, P.O. Box 416, Hinckley, Ohio 44233

[21] Appl. No.: 566,917

[22] Filed: Dec. 29, 1983

[51] Int. Cl.[4] ..... B42F 3/02; B42F 13/02

[52] U.S. Cl. ..... 402/22; 402/21; 402/19

[58] Field of Search ..... 402/21, 22, 29, 30, 402/80 P

[56] References Cited

U.S. PATENT DOCUMENTS

| | | | |
|---|---|---|---|
| 2,321,558 | 6/1943 | Trussell | 402/21 |
| 2,321,559 | 6/1943 | Trussell | 402/21 |
| 2,321,560 | 6/1943 | Trussell | 402/21 |
| 2,322,177 | 6/1943 | Trussell | 402/21 |
| 2,323,285 | 6/1943 | Trussell | 402/21 |
| 2,459,541 | 1/1949 | Russell | 402/21 |
| 3,313,303 | 4/1967 | Beyer | 402/30 |
| 3,313,304 | 4/1967 | Beyer . | |
| 3,529,900 | 9/1970 | Pettit . | |
| 3,950,107 | 4/1976 | Seaborn | 402/22 |

FOREIGN PATENT DOCUMENTS

| | | | |
|---|---|---|---|
| 0713853 | 7/1965 | Canada | 402/80 P |

OTHER PUBLICATIONS

Three Instant Photos.

*Primary Examiner*—Robert L. Spruill
*Assistant Examiner*—Taylor J. Ross
*Attorney, Agent, or Firm*—Watts, Hoffmann, Fisher & Heinke Co.

[57] ABSTRACT

A ring binder having flexible ring elements for holding sheets of paper or the like in an organized manner. The binder includes a backplate integrally coupled to a number of ring elements by a living hinge to allow flexing of the ring elements to and from a locked position. The ring elements each include a flanged end which is inserted into an entrance of a keyway, then pushed past a narrow neck to a locked position. Movement of the ring away from this locked position to the entrance is inhibited by a camming surface defined by the backplate.

3 Claims, 9 Drawing Figures

RING BINDER

DESCRIPTION

1. Technical Field

The present invention relates to a low cost ring binder for organizing sheets of paper or the like.

2. Background Art

Low cost injection molded ring binders have found wide use in catalogs and the like because they provide an inexpensive way to removably bind paper. A particularly suitable and commercially successful binder of this type is shown in Beyer U.S. Pat. No. 3,313,304 The rings in that binder are integral with and individually hinged at one side edge of a backplate. The rings are releasably secured at their free ends in spaced apertures formed adjacent an opposite side of the backplate. Each aperture includes a large entrance portion and a narrow locking portion with the locking portion directly opposite the point where the ring is hinged to the backplate. The entrance portion is longitudinally offset from this point along the backplate.

Two of the entrance portions of these apertures are offset in one direction from the base portion of their associated ring elements while the entrance portion of a third aperture is offset in an opposite direction. This configuration prevents sheets carried by the binder elements from shifting longitudinally of the backplate and moving all three binder ring elements from the locking portions of the apertures to the entrance portions.

While the above-described arrangement works adequately with moderately sized rings, larger ring sizes of about an inch present problems due to the weight of paper these rings are capable of binding. This added weight can distort one ring and thereby move longitudinally of the backplate by causing the free ends of the other two rings to be removed from the locking portions of the apertures when the binder is placed on end, allowing the papers to become dislodged from two of the rings.

DISCLOSURE OF INVENTION

The present invention provides a reliable ring binder less prone to inadvertent opening. This is accomplished by a new and improved design of the apertures or keyways which hold the ring elements in place.

The ring binder includes an elongated backplate and one or more flexible, deformable ring elements each integrally secured at one end along an edge of the backplate and having an opposite flanged free end that can be secured to the backplate adjacent an opposite edge in a transverse rather than longitudinally extending keyway. Each keyway has a narrow portion adjacent the opposite edge and a wide portion laterally inward from the edge for receiving the flanged end of a ring element.

The backplate has a thickness sufficient to accommodate insertion of the free ends into the apertures, which are in an upper wall. Longitudinal side walls and transverse end walls give the backplate a solid appearance, yet space the upper wall from base edges, which lie in a common plane and rest against the spine of a binder cover. The upper wall is convexly curved in a transverse direction to provide a rigidity and a pleasing appearance.

With the flanged ring ends free from the backplate, the user places sheets of paper or the like over the rings and then secures the free ends to the backplate. This is done by passing the flanged end of each ring through a wide entrance portion of a keyway and then pushing the ring to a narrow locking portion. An inner or back surface of the backplate defines a cam surface which frictionally engages the flanged end to inhibit movement of the ring element back toward the wider entrance. The cam surface requires movement of the flanged, free end farther into the aperture in a direction perpendicular to the backplate during purposeful opening, thereby preventing inadvertent opening of the ring.

The camming surface is preferably defined by the distal ends of two walls that project perpendicularly from the upper wall toward the plane of the base edges on either side of the narrow keyway portion. Edges of these walls run in a plane at least roughly parallel to the plane of the base edges of the backplate and preferably slightly inclined toward the base considered in a direction from the side wall toward the interior of the backplate, rather than following the curved contour of the top wall of the backplate. This camming surface orientation diminishes the likelihood that forces acting on the ring elements will pull the flanged ring end toward the wider keyway opening.

The transverse orientation of the keyways also inhibits inadvertent opening of a ring elements. Longitudinal loading of pages against the rings, when a binder is stood on end, presses the rings against the sides of the keyways rather toward the keyway entrances.

In a preferred embodiment of the invention, each keyway has a narrow neck portion connecting its locking and entrance openings. The flanged ring end is locked in place by first flexing the ring member away from an equilibrium position and bringing the flanged member into alignment with the wide entrance passageway. The user then pushes the ring into the wide entrance and slides the ring past the neck portion to the locking portion. Movement away from this position is inhibited by both the neck and the cam surfaces.

Inadvertent opening of the ring elements is further inhibited by the resistance of the ring members to deformation, which is required to move the flanged ends transversely of the backplate from the locking portions of the apertures to the entrance portions.

The backplate and ring elements are preferably constructed from plastic and are formed using an injection molding technique known in the art. In this preferred embodiment the backplate is attached to a folder by rivets extending through mounting holes in the backplate.

From above it should be appreciated that two features of the invention are economy and reliablity. These and other features of the invention will be better understood from the description of a preferred embodiment and consideration of the accompanying drawings.

BEST MODE FOR CARRYING OUT THE INVENTION

Figure 1:
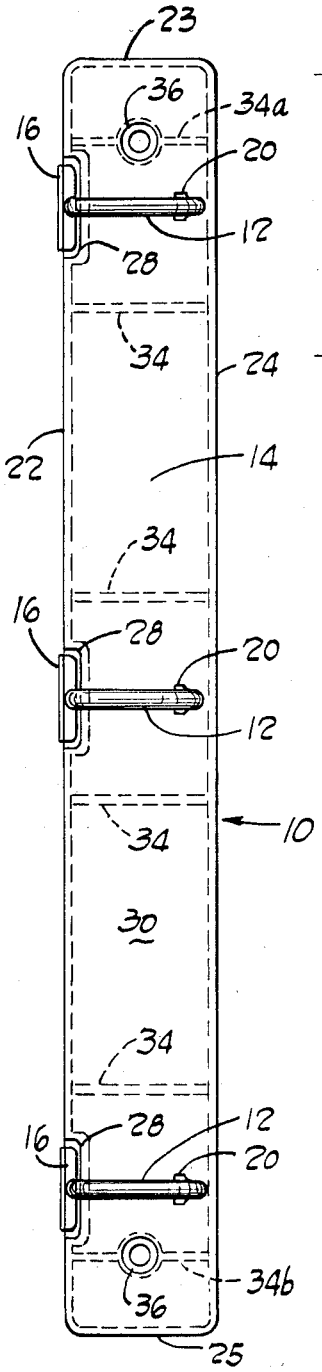
FIG. 1 is a top plan view of a ring mechanism constructed in accordance with the present invention.
Figure 5:
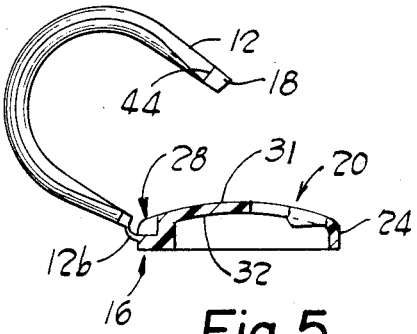
FIG. 5 is a partially sectioned view of the FIG. 4 ring taken along the line 5—5 in FIG. 4.

FIG. 1 shows an injection molded one-piece plastic ring binder 10 intended to be fastened against the spine of a cover to form a notebook or catalog containing removable sheets, e.g., sheets of paper. The ringbinder includes a backplate 14 and three integral rings 12 connected to the backplate by living hinges 16 that allow the rings to be flexed from an open position (FIG. 5) where sheets of paper or the like can be slipped over the rings to a closed position (FIG. 2) where a flanged end 18 of each ring 12 is locked in place by a keyway 20 defined by the backplate 14.

The backplate 14 is rectangular in plan, being long and narrow, formed of longitudinal side walls 22, 24 and end walls 23, 25, all short in height, and a top wall 30 that is transversely curved, having a convex outer surface 31 and a concave inner surface 32. Three step-like recesses 28 are formed in the backplate along the longitudinal wall 22 and in the top wall 30 to receive a wide base portion **12*b* of each ring to provide substantial length to each living hinge. At spaced locations along the backplate 14 ribs 34 extend across the width of the backplate from one longitudinal sidewall edge 22 to the other 24. Two of these ribs 34*a*, 34*b* are interrupted in the middle by a collar 36 through which a rivet or the like can be inserted to hold the backplate 14** against a binder spine.

Figure 7:
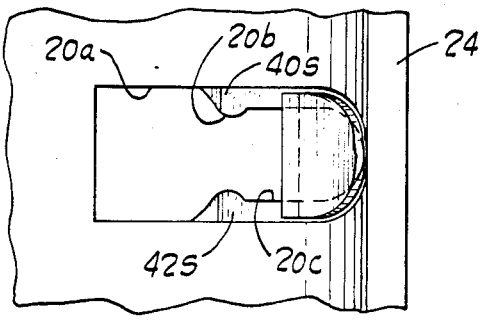
FIG. 7 is a bottom plan view of the keyway.
Figure 8:
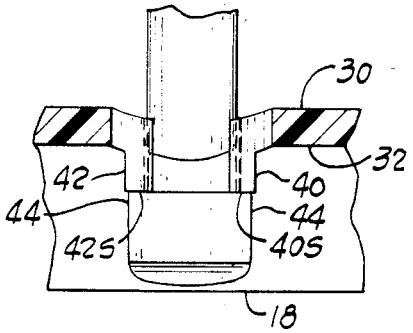
FIG. 8 is a sectioned view of the base taken along the line 8—8 of FIG. 6 showing coaction between the keyway and a flanged end of a ring element.
Figure 9:
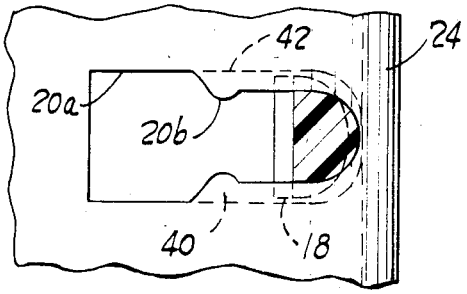
FIG. 9 is a partial top plan view, partly in section, of the ring and keyway shown in FIG. 6 taken along the line 9—9.

The keyways 20 (FIG. 7) abut the longitudinal edge 24 and extend in a direction transverse to this edge. Each keyway 20 has a wide entrance opening **20*a* of sufficient cross-section to allow the flanged end 18 of an associated ring element 12 to be inserted into the keyway until it abuts the binder spine. To position the ring for insertion into this wide portion 20*a*, the ring must be flexed away from an equilibrium position in a direction perpendicular to the longitudinal edges 22, 24**, toward the hinge.

Once the flanged end of the ring 12 is inserted through the wide entrance portion **20*a*, it is pushed back toward its unflexed position by forcing it past a neck portion 20*b* of the keyway 20. Once the ring 12 is past this neck 20*b*, it is locked in place in a slightly elongated narrow portion 20*c* of the keyway 20. This narrow portion 20*c* is wide enough to accommodate the ring but narrower than the flanged end portion 18** so that forces tending to pull the ring away from the backplate in a direction generally perpendicular to the top wall not open the ring.

Figure 6:
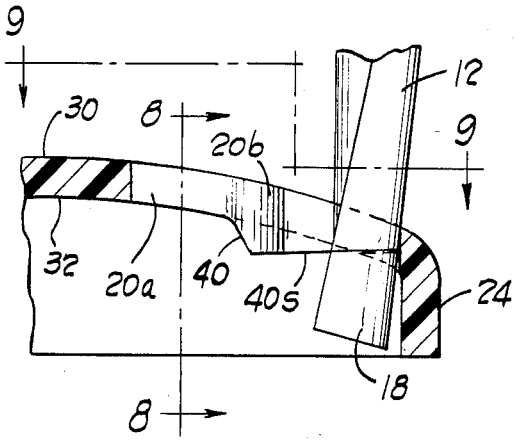
FIG. 6 is an enlarged partially sectioned view of a portion of the base of FIG. 5 showing a keyway through which a flanged end of a ring is inserted to lock the ring in place.

Extending alongside the narrow **20*c* and neck 20*b* portions of the keyway 20 and forming a part of the inner convex surface 32 are two camming walls 40, 42 having camming surfaces 40*s*, 42*s* that coact with the flanged ring end 18. These walls 40, 42 alter the curvature of the convex inner surface 32 to inhibit movement of the flanged ring portion 18 back toward the wider entrance portion 20*a* of the keyway 20. As seen most clearly in FIG. 6, the camming surfaces 40*s*, 42*s* extend away from the longitudinal wall 24 at a different angle than the concave inner surface 32. In particular, the camming surfaces 40 s, 42*s* extend slightly toward the base, are oblique to the edge 24 and define an acute angle with that edge. The convex inner surface 32, however, curves upward away from the base and defines a generally obtuse angle with the edge 24 as seen in FIG. 6. These camming surfaces 40*s*, 42*s* contact shoulders 44 at the flanged end 18 of the ring 12** and inhibit lateral movement of the ring ends away from the locked position shown in FIG. 6 when tension forces are applied to the ring.

Figure 2:
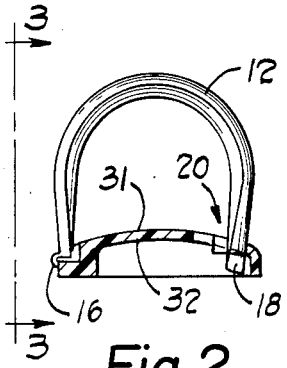
FIG. 2 is a partially sectioned view of the FIG. 1 mechanism showing a ring element hinged to a base member or backplate.
Figure 3:
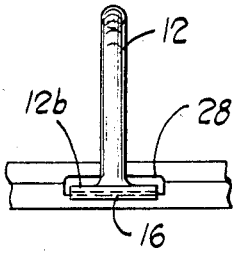
FIG. 3 is a view of the mechanism taken along the line 3—3 in FIG. 2.
Figure 4:
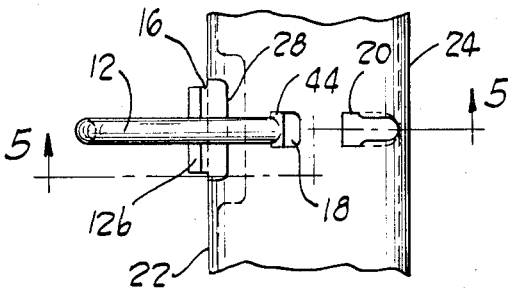
FIG. 4 is an enlarged partial plan view of the FIG. 1 mechanism showing one end of a ring element pivoted away from the base member to a position in which sheets can be inserted or removed from the ring mechanism.

Inadvertent opening of the ring element 12 is also inhibited by a tendency of the ring to resist flexing. The equilibrium position of the ring is shown in FIG. 2. To bend the ring 12 so that the flanged end 18 can be inserted into the entrance portion **20*a* of the keyway 20, the user must exert a force to overcome the natural restoring force of the ring. This restoring force in conjunction with the camming surfaces 40*s*, 42*s* and narrow neck portion 20*b* of the keyway 20 all tend to inhibit the movement and inadvertent opening of the ring elements 12. Since the keyway 20 extends in a transverse direction across the width of the backplate 14, when the ring binder 10 is placed on end, the weight of the papers in the binder act on the rings 12 in a direction perpendicular to the transverse keyways 20 and does not tend to move the flanged end 18 to the entrance 20*a***.

The preferred material for molding the ring binder 10 is polypropylene. Suitable alternative materials could be substituted however, so long as these alternate materials are flexible enough to allow insertion and locking of the ring elements and provide a satisfactory hinge. The present invention has been described with particularity, but it is the intent that all alterations and modifications falling within the spirit or scope of the appended claims be protected.

I claim:

1. A ring binder comprising:

an elongated backplate having a convex top surface facing away from a spine of a binder a concave wall surface facing toward said spine and futher comprising first and second longitudinal edges defining a base surface;

a plurality of elongated binder ring elements with one end integrally hinged along the first longitudinal edge of said backplate, said ring elements extending outward from said top surface to a free end with flanged sides;

said backplate defining apertures, one for each ring element, transversely aligned with the right elements across said backplate and having a wide portion to receive said free end, a narrow portion adjacent the second longitudinal edge of said backplate narrower than the flanged end of said ring elements, and a neck portion intermediate the wide and narrow portions;

said wall surface defining a planar camming surface angled from said second edge toward, said back surface along said narrow portion to inhibit movement of said flanged end along the wall surface past the neck portion to said wide portion.

2. The ring binder of claim 1 where the camming surface forms an acute angle with said longitudinal edge.

3. A ring binder comprising:

an injection molded elongated backplate having first and second longitudinal edges, a transversely curved outwardly convex top wall, two longitudinal side walls defining a base surface to be secured to a binder cover, a plurality of integral ring members hinged to the backplate along said first edge, said ring members having free ends that have at least one flange extending to the side of the ring member in the longitudinal direction of the backplate, and a plurality of aperture in the top wall adjacent the second longitudinal edge, one aligned transversely with each ring member, said apertures being elongated transversely of the backplate and having a wide portion inwardly of the second edge and a narrow portion adjacent the second edge, the wide portion being wider than the flanged ends of the ring elements and the narrow portion being wider than the ring elements but narrower than the flanged ends, said backplate including an inclined planar camming surface along each of two sides of the narrow portion of each aperture, extending laterally of the backplate, facing toward the base surface and sloping toward the base surface from the second edge laterally inward, said camming surface adapted to contact the flange of a ring along both sides of the narrow portion of each aperture to inhibit movement of the flanged portion of a ring member to the wide portion of an aperture.

* * * * *